United States Patent [19]

Poe

[11] 4,265,474

[45] May 5, 1981

[54] FLUSH TYPE ROTARY DRIVE FOR LATCHES

[75] Inventor: L. Richard Poe, Long Beach, Calif.

[73] Assignee: Hartwell Corporation, Placentia, Calif.

[21] Appl. No.: 20,506

[22] Filed: Mar. 14, 1979

Related U.S. Application Data

[63] Continuation of Ser. No. 856,504, Dec. 1, 1977, abandoned.

[51] Int. Cl.[3] ..... E05C 3/04; E05B 17/00

[52] U.S. Cl. ..... 292/241; 70/438; 70/441; 70/DIG. 59; 292/101; 292/140

[58] Field of Search ..... 292/241, 240, 57, 58, 292/60-65, 67, 69, 140, 159, 37, 96, 101, 106; 70/432, 438, 441, DIG. 20, DIG. 59; 24/230 AP

[56] References Cited

U.S. PATENT DOCUMENTS

| | | | |
|---|---|---|---|
| 373,985 | 11/1887 | Johnson | 292/58 |
| 704,014 | 7/1902 | Espitallier | 292/58 |
| 1,152,443 | 9/1915 | Shaw | 70/438 |
| 1,639,661 | 8/1927 | Newcomb | 292/62 |
| 2,095,271 | 10/1937 | Swanstrom | 292/59 |
| 2,143,626 | 1/1939 | Jones | 292/58 X |
| 2,919,569 | 1/1960 | Davis | 70/97 |
| 2,969,667 | 1/1961 | Newcomer, Jr. et al. | 292/140 X |
| 3,254,517 | 6/1966 | Wheeler | 70/97 |
| 3,402,379 | 9/1968 | Amis, Jr. et al. | 292/252 X |
| 3,503,642 | 3/1970 | Poe | 70/432 |
| 3,907,348 | 9/1975 | Bates et al. | 292/241 X |
| 4,061,370 | 12/1977 | Hauber | 70/432 X |

FOREIGN PATENT DOCUMENTS

| | | | |
|---|---|---|---|
| 470419 | 6/1914 | France | 292/140 |
| 27593 | 4/1924 | France | 292/140 |

*Primary Examiner*—William E. Lyddane
*Attorney, Agent, or Firm*—Lyon & Lyon

[57] ABSTRACT

A flush type rotary drive means which is caused to move between a position flush with a surrounding surface and a protruding position as the latch is moved between its locked position and its unlatched position, the drive means, by reason of its protruding position, being readily visible to indicate the partially or completely unlocked condition of the latch; one embodiment being arranged to move a reciprocable latch; another embodiment being arranged to turn a rotary latch.

4 Claims, 14 Drawing Figures

FLUSH TYPE ROTARY DRIVE FOR LATCHES

This application is a continuation application of U.S. patent application Ser. No. 856,504 filed Dec. 1, 1977, now abandoned.

BACKGROUND AND SUMMARY

Flush type rotationally driven latches are used extensively on aircraft; however, as the driving means remains in a flush condition whether or not the latch is in its locked or released position, observation of the exposed portions thereof gives no indication as to whether the latch is in its open or closed position.

The present invention is directed to a flush type rotary driven latch which overcomes this problem and is summarized in the following objects:

First, to provide a flush type latch utilizing a novelly arranged rotary drive means, wherein as the drive means turns to release the latch, the drive means moves from an initially flush position to a protruding, readily visible position.

Second, to provide a rotary drive means as indicated in the preceding object which may be adapted to various types of latches, such as reciprocable latches or rotatable latches.

BRIEF DESCRIPTION OF THE FIGURES

FIGS. 10 through 13 illustrate another embodiment of the flush type rotary drive for latches in which FIG. 10 is an elevational view indicated by dotted and broken lines of a movable panel and the unlatched and latched positions of a hook type latch.

FIG. 11 is an enlarged sectional view taken through 11—11 of FIG. 10.

FIG. 12 is an enlarged fragmentary sectional view taken through 12—12 of FIG. 11.

FIG. 13 is an enlarged fragmentary sectional view in the same plane as FIG. 11 showing the latch in its unlatched condition.

DETAILED DESCRIPTION

Figure 1:
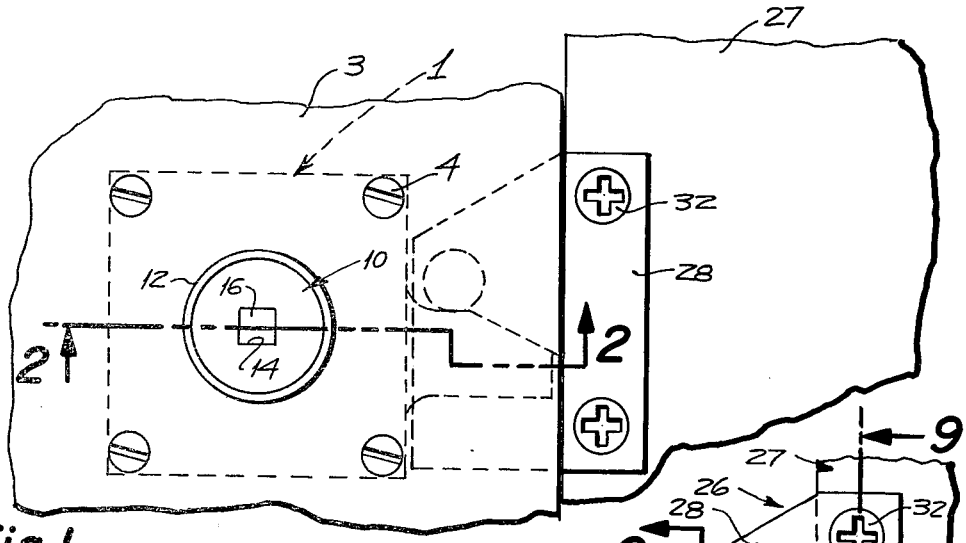
FIG. 1 is a fragmentary view indicating a portion of the surface of a removable or hinged panel and an adjacent portion of the structure in which the panel is mounted showing the flush type rotary drive for latches including both the latch and the keeper, concealed portions being indicated by broken lines.
Figure 2:
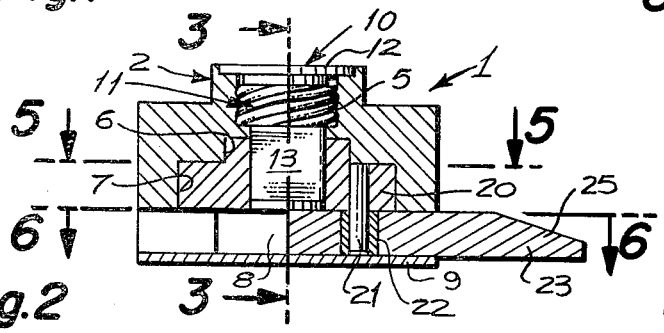
FIG. 2 is a sectional view of the latch and drive mechanism taken through 2—2 of FIG. 1 with the panel omitted.
Figure 7:
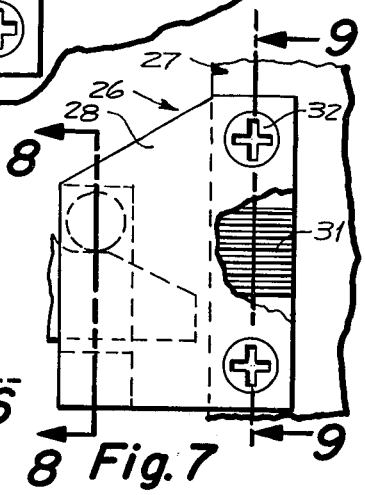
FIG. 7 is an elevational view of the keeper indicated by broken lines and also indicating by broken lines the relative position of the latch when in its locked condition.
Figure 3:
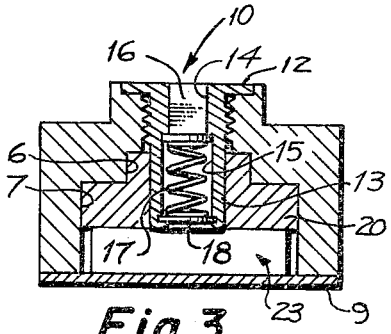
FIG. 3 is a sectional view of the latch and drive taken through 3—3 of FIG. 2 showing the drive in its retracted position.

Referring to FIGS. 1 through 6, the flush type rotary drive for latches herein illustrated includes a body 1 which may be in the form of a rectangular block provided at one side with a central outwardly extending boss 2. The body is mounted on an aircraft panel 3 which may be a hinged door or may be removable. The body 1 is attached to the panel by screws 4.

Centered in the boss 2 is a multiple pitch screwthreaded bore 5. Inwardly therefrom there is provided a first enlarged bore 6 and a further enlarged bore 7 coaxial with the screwthreaded bore 5. Below the enlarged bore 7 is a cross slot 8 which receives a cover plate 9.

The body 1 receives a drive member 10 having a multiple pitch screw portion 11 provided with a small flanged end 12. Below the screw portion, the drive member forms a drive shaft 13 of polygonal, preferably square, cross-section. Internally, the upper portion of the drive member is provided with a bore 14 of polygonal cross-section, preferably square. Below the bore 14 there is provided a circular counter bore 15.

Figure 4:
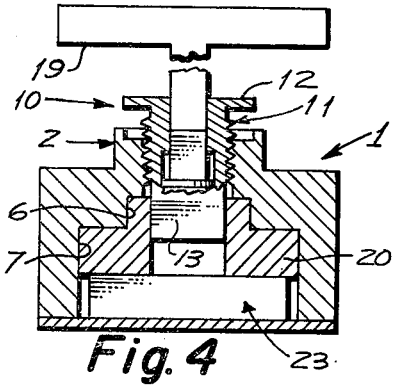
FIG. 4 is a similar sectional view showing the drive in its extended position.
Figure 8:
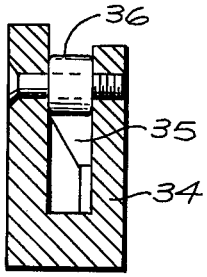
FIGS. 8 and 9 are sectional views taken through 8—8 and 9—9 respectively of FIG. 7.
Figure 5:
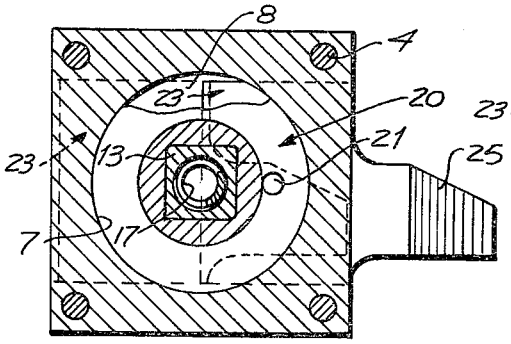
FIG. 5 is a sectional view taken through 5—5 of FIG. 2 showing the latch by solid lines in its extended position and by dotted lines in its retracted position.
Figure 6:
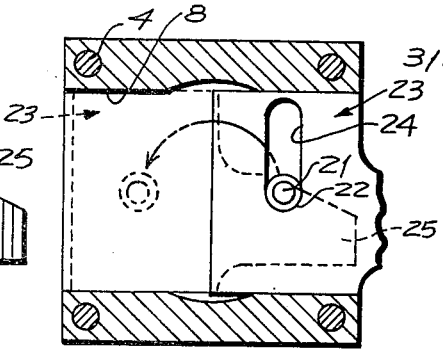
FIG. 6 is another sectional view taken through 6—6 of FIG. 2 showing the latch exposed and in its extended position by solid lines and in its retracted position by dotted lines.
Figure 9:
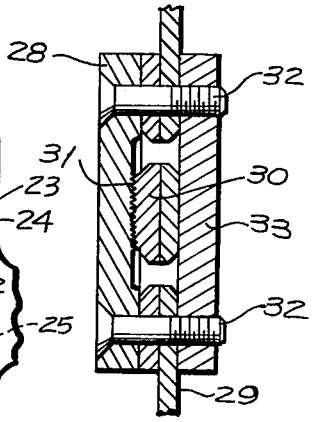

The polygonal bore 14 receives a correspondingly shaped slidable plug 16 flanged at its lower end. A spring 17 in the counter bore 15 bears between the flanged end of the plug 16 and a plate 18 at the lower end of the counter bore to maintain the exposed end of the plug 16 flush with the outer surface of the flanged end 12 of the drive member 10. A turning tool 19 is provided having a polygonal shape corresponding to the bore 14, as indicated in FIG. 4.

The counter bores 6 and 7 receive a drive disk 20, a cross bore of polygonal cross-section into which extends the drive shaft 13, the drive disk having a depending drive pin 21 provided with a roller 22 which projects into the cross slot 8. Slidably mounted in the cross slot 8 is a latch plate 23 having a transverse drive slot 24 which receives the pin 21 and roller 22 so that upon rotation of the drive member 10 and drive disk 20, the latch plate 23 may be reciprocated. Extending from the latch plate 23 is a latch member 25 movable between an extended and a retracted position.

Referring to FIG. 1 and FIGS. 7, 8 and 9, there is illustrated a keeper 26 carried by the wall surrounding the aircraft panel 3, such wall being indicated fragmentarily and indicated by 27. The keeper includes a mounting plate 28 secured to a supporting member 29 forming a part of the aircraft. Mounted on the supporting member 29 is an adjustment strip 30. The mounting plate 28 and the adjustment strip 30 are provided with mating serrations 31 so that the position of the mounting plate with respect to the support member may be adjusted. Screws 32 extend through the supporting member 29 into a plate 33 so that the mounting plate 28 may be secured in a predetermined position. The mounting plate 28 extends toward the body 1 into proximity therewith. At this end, the mounting plate supports a spaced guide bar 34 joined thereto by a connecting web 35 and a connecting roller 36 defining an opening for receiving the latch member 25.

Operation of the rotary drive and latch shown in FIGS. 1 through 9 is as follows:

The body 1 is so mounted in the aircraft panel 3 that the boss 2, the flanged end 12 of the drive member 10 and the outer end of the plug 16 are all flush with the outer surface of the panel, when the latch member 25 is received in the keeper 27. The latch member 25 is retracted upon insertion of a tool 19 in the drive bore 14 and the drive member 10 is rotated. Rotation of the drive member 10 causes the drive member to protrude as indicated in FIG. 4. As a half turn is adequate for retracting the latch member, the screw portion 11 is multiple pitched by a factor of 8 or 10. In its protruding condition, the drive member is readily visible so that the condition of the latch is readily ascertained.

Referring to FIGS. 10 through 14, this embodiment of the flush type rotary drive for latches includes a body 41 having a cylindrical recess 42 at its underside intersected by a radial keeper slot 43. Centered with respect to the cylindrical recess 42 and extending upwardly from the body 41 is an integral sleeve 44. The extended end of the sleeve is reduced in external diameter as indicated by 45 which is received in an opening provided in a panel 46 or other mounting member so that the outer extremity of the sleeve 44 is flush therewith. The body 41 is provided with a counterbore 47 coaxial with the sleeve 44. The underside of the body 41 is provided with a bottom cover plate 48 having a radial channel 49.

Received in the recess 42 is a hook type latch 50 having a part circle journal hub 51 having a upper portion extending into the counterbore 47. As shown best in FIG. 10, the latch 50 includes a radial portion 52 joined to a hook latch 53 occupying approximately a half cicle and tapering from the radial portion 52 towards its extremity.

Figure 14:
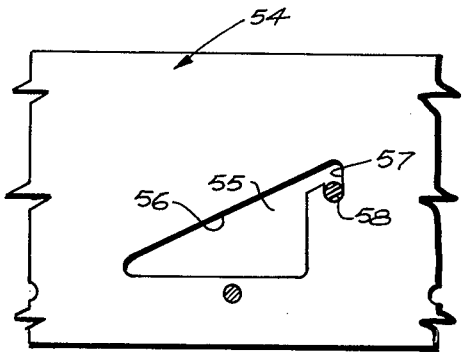
FIG. 14 is a developed view of the cam sleeve.
Figure 11:
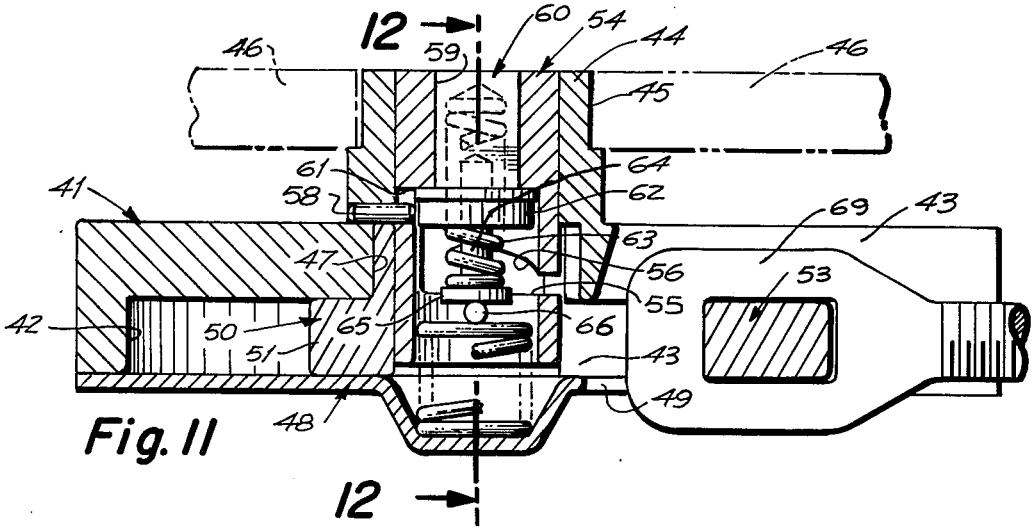
Figure 13:
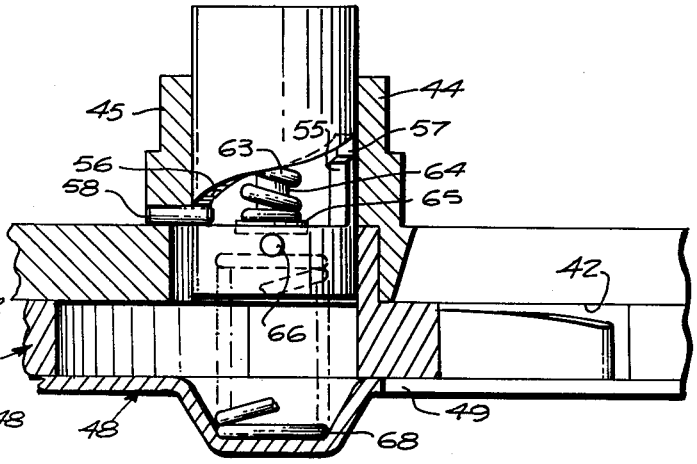

Received in the sleeve 44 is an inner sleeve 54, as shown best in FIG. 14, having a triangular slot 55 in its side wall oocupying approximately 180°, that is, the arcuate extent of the cam slot is substantially the same as the arcuate extent of the hook latch 53. The upper margin of the cam slot 55 is helical as indicated by 56 tapering upwardly from one extremity of the cam slot. At its upper extremity, it merges to a hook slot 57. A cam pin 58 extends radially through a wall of the outer sleeve 44 immediately above the body 41 and engages the cam slot 55, as indicated by FIGS. 11 and 13.

Figure 12:
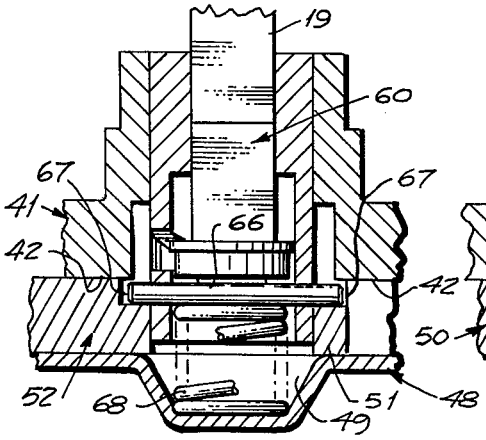

The upper portion of the inner or cam sleeve 54 is provided with a square bore 59 which receives a square closure pin 60. The inner end of the bore 59 terminates in a shoulder 61 and the inner end of the pin 60 is provided with a head 62 which bears against the shoulder 61. The closure pin is provided with a socket accessible through the head 62 and receives a spring 63. The spring 63 receives a guide pin 64 having a head 65 which engages a cross bar 66. The ends of the cross bar 66 extend through the walls of the sleeve 54 and are received in vertical slots 67 disposed 180° apart and extend upwardly through the upper end of the hook latch hub 51, thereby forming a drive connection between the inner sleeve 54 and the hook latch 50 as indicated in FIG. 12. Interposed between the cross bar 66 and the radially inner end of the channel 49 is a spring 68.

The radial slot 43 and hook latch 53 are dimensioned to receive a loop type keeper 69 which in itself may be considered as conventional.

Figure 10:
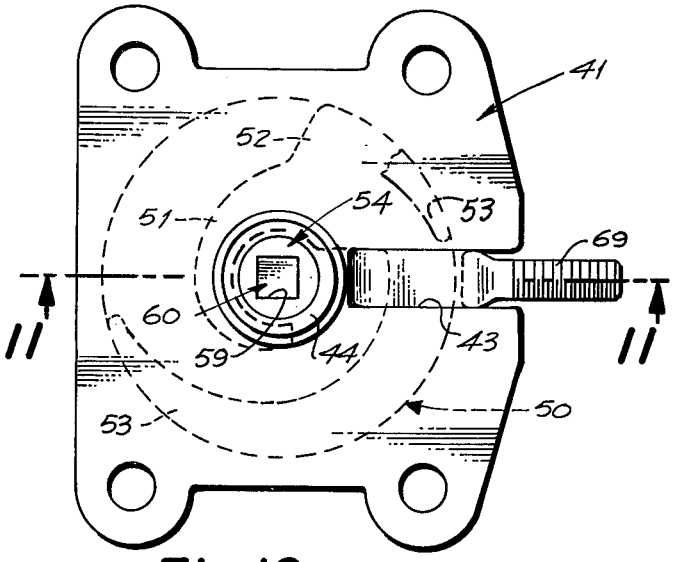

Operation of the embodiment shown in FIGS. 10 through 14 is as follows:

When the keeper 69 is secured in position by the hook latch 53, the various parts are in the positions shown in FIGS. 10 and 11. Both the inner or cam sleeve 54 and closure pin 60 are flush with the upper end of the outer sleeve 44, and thus flush with the outer surface of the panel 46. To operate the latch, a polygonal tool 19 such as used in the first embodiment is forced into the bore 59 and turned either to withdraw the hook latch 53 from the position shown in FIGS. 10 and 11 or to move the hook latch in the opposite direction if the hook latch and keeper are disengaged. When the latch is in its secured position shown in FIGS. 10 and 11, the cam pin 58 is in the hook slot 57 held therein by the force of the spring 63. In order to remove the cam pin from the hook latch 57, slight downward movement of the inner or cam sleeve 54 is needed, which is accomplished by the downward force of the tool 19. Once disengaged from the hook slot, the cam pin rides the upper margin 56 of the inner sleever 54; the inner sleeve moves upwardly from its flush position and rises above the outer sleeve 44 until the keeper 69 is completely disengaged as indicated in FIG. 13.

It will thus be observed that operation of the embodiment shown in FIGS. 10 through 14 is in many respects similar to that shown in FIGS. 1 through 9. In fact, the multiple screw drive provided in FIGS. 1 through 9 may be substituted for the cam drive shown in FIGS. 10 through 14 or the cam drive may be substituted for the screw drive in FIGS. 1 through 9.

Having fully described my invention, it is to be understood that I am not to be limited to the details herein set forth, but that my invention is of the full scope of the appended claims.

I claim:

1. A rotary latch comprising:

a. a keeper means;

b. an outer sleeve;

c. an inner indicating member received within said outer sleeve, said inner indicating member being adapted for axial movement within said outer sleeve;

d. a latch arm operatively connected to said inner indicating member and arcuately movable between a secured position and a released position with respect to said keeper means;

e. a projecting element positioned within said outer sleeve and extending inwardly therefrom;

f. a retaining aperature means at the exterior of said inner indicating member for engaging said projecting element when said latch arm and keeper are in said secured position, thereby locking said latch arm and said keeper in said secured position by preventing rotational movement of said inner indicating member within said outer sleeve, and for disengaging said projecting element upon axial movement of said inner indicating member within said outer sleeve in order to permit rotational and axial movement of said inner indicating member and movement of said latch relative to said keeper.

2. The rotary latch claimed in claim 1 wherein said inner indicating member retaining aperature is further defined as being helical and substantially triangular in projection.

3. The rotary latch claimed in claim 2 wherein the arcuate rotation of said inner indicating member is substantially the same as the arcuate rotation of said latch arm.

4. The rotary latch claimed in claim 1 wherein said projecting element is further defined as being a pin adapted for engagement within said retaining aperature means.

* * * * *